United States Patent [19]

Foster

[11] 4,327,918

[45] May 4, 1982

[54] APPARATUS FOR TRAINING GOLF PLAYERS

[75] Inventor: David B. Foster, Windlesham, England

[73] Assignee: Learning Games Limited, London, England

[21] Appl. No.: 10,365

[22] Filed: Feb. 8, 1979

Related U.S. Application Data

[63] Continuation-in-part of Ser. No. 806,588, Jun. 15, 1977, Pat. No. 4,146,230.

[51] Int. Cl.[3] ..... A63B 69/36

[52] U.S. Cl. ..... 273/186 R

[58] Field of Search ..... 273/181 H, 186 R, 186 RA, 273/310–312

[56] References Cited

U.S. PATENT DOCUMENTS

| | | | |
|---|---|---|---|
| 2,581,738 | 1/1952 | Williams | 273/181 H |
| 2,825,569 | 3/1958 | Alvarez | 273/186 RA |
| 3,601,408 | 8/1971 | Wright | 273/186 RA |
| 3,792,863 | 2/1974 | Evans | 273/186 A |
| 4,065,860 | 1/1978 | Linton et al. | 273/310 X |
| 4,155,555 | 5/1979 | Fink | 273/186 RA |
| 4,180,270 | 12/1979 | Long | 273/186 R |
| 4,254,956 | 3/1981 | Rusnak | 273/186 R |

FOREIGN PATENT DOCUMENTS

| | | | |
|---|---|---|---|
| 1511051 | 5/1978 | United Kingdom | 273/186 RA |

*Primary Examiner*—Vance Y. Hum

*Attorney, Agent, or Firm*—Biebel, French & Nauman

[57] ABSTRACT

The present invention concerns golf teaching apparatus in which a student swings a golf club over a target area having photocells. The outputs from the photocells are analyzed and displayed to give an indication of yardage and faults in the student's swing. In particular the photocells include two transverse arrays which are partially darkened by a passing golf club shadow so that the relationship between the number of photo devices darkened in the upstream array to those darkened in the downstream array is an indication of golf club direction. The invention is directed to concerning the error which arises if the two arrays are not located for maximum accuracy. Thus in accordance with the invention the two arrays are located symmetrically on either side of a line tangential to the target ball and at right angles to an ideal path of a golf club head when it impacts the target ball.

2 Claims, 4 Drawing Figures

Fig.2
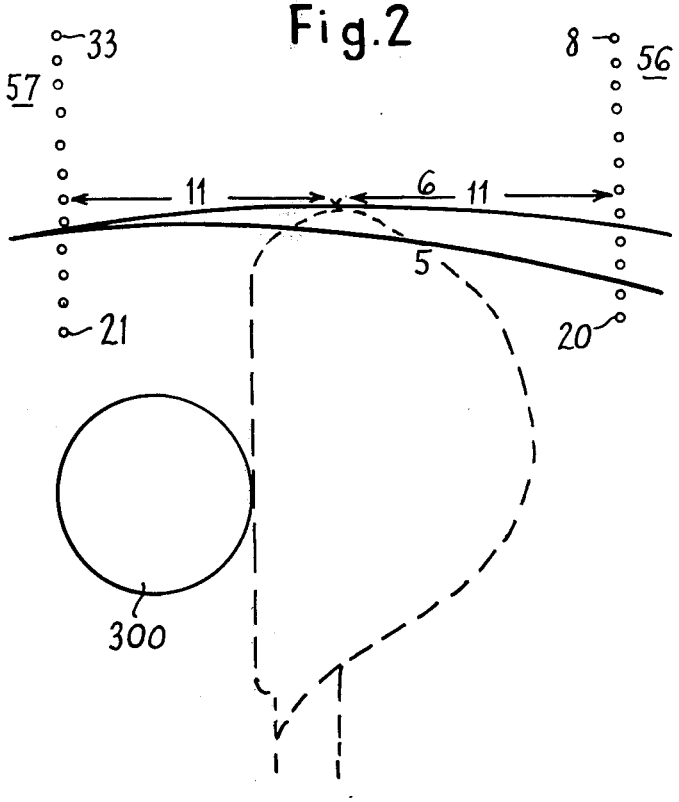
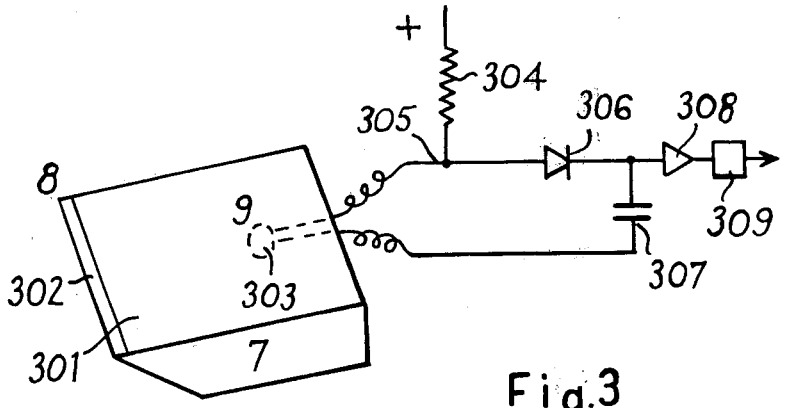
Fig.3

168
169
170
171
173
50
39
1
2
5a
5b
38
41
40
42
43
47
49
54
55
56
42
45
46
44
48
53
52
51
115
114
116
117
3
4
98
99
100
110
112
6a
7a
101
102
103
6b
7b
104
105
106
111
113
109
107
108
95
94
93
92
89
91
88
90
87
60
86
33
31
57
62
63
64
23
21
73
70
69
71
74
76
65
66
67
77
20
56
14
58
59
61
76
78
72
78
75
68
8
120
125
34
118
119
121
122
123
124
126
127

APPARATUS FOR TRAINING GOLF PLAYERS

BACKGROUND OF THE INVENTION

The present invention relates to apparatus for training golf players and is a continuation-in-part of U.S. Pat. application Ser. No. 806,588 filed June 15, 1977, now U.S. Pat. No. 4,146,230 and assigned to the present applicants.

U.S. application Ser. No. 806,588 describes golf training apparatus comprising a base member having an impact area over which a golfer may swing a golf club to strike a target ball carried in the impact area, a light source arranged to direct light onto the impact area to cause a shadow of the golf club head to fall on the impact area as it passes thereover, a plurality of photoelectric cells distributed in said area so as to receive light from said source and which may be momentarily shadowed during the passage of the club, and signal processing means for correlating signals received from the photocells during the passage of a golf club over the impact area to provide data relating to an impact of the club on the target ball.

SUMMARY OF THE INVENTION

The present application is concerned with improvements in golf training apparatus described in the aforesaid application.

It has for an object to provide golf training apparatus which provides a considerable degree of accuracy in the information that it can convey concerning a player's golf swing up to and including the point of impact.

The invention also has for an object to provide golf training apparatus including an improved form of photo-detector device.

Other features and advantages will become apparent by a perusal of the following description taken in conjunction with the accompanying drawings which show certain embodiments and circuit arrangements for use therein by way of example and in which:

BRIEF DESCRIPTION OF THE DRAWINGS

FIG. 2 is a plan view of the impact area of FIG. 1, FIG. 3 shows a photoelectric device.

DETAILED DESCRIPTION OF THE PREFERRED EMBODIMENT

Figure 1:
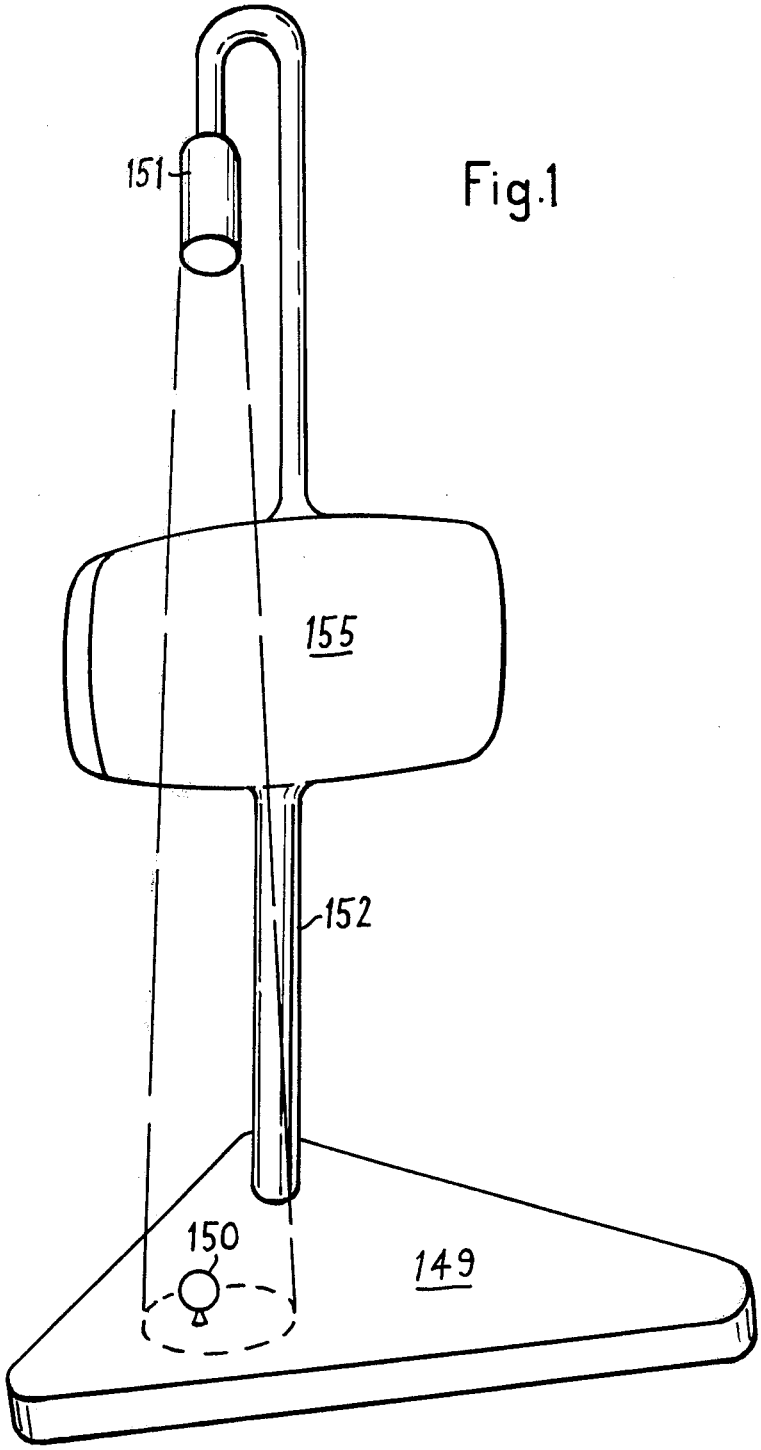
FIG. 1 is a perspective view of an embodiment of golf training apparatus constructed in accordance with the present invention.

Referring now to the drawings, the physical form of the mechanical parts of the apparatus is substantially identical to that described in U.S. Ser. No. 806,588 the entire contents of which are incorporated herein by way of reference. Nevertheless certain salient features will be described herein for the sake of clarity.

Thus as shown in FIG. 1 a preferred embodiment of the golf training apparatus comprises a strike mat 149 on which a ball 150 is placed in an accurate and specific location. A stand 152 leads to a projector lamp 151 consisting of lamp and condenser lens and this throws a beam down to the ball and creates a sharp shadow of the golf club head used to strike the ball. Under the strike mat in this illuminated zone is an arrangement of photoswitches and apertures in the strike mat (not shown in this Figure) which allow the light to penetrate to them.

The ball 150 may be a real golf ball but, particularly if the apparatus is set up inside may be a simulated golf ball as will be described hereinafter.

Mounted on the stand 152 at a convenient height for viewing is a display 155 which reveals the data processed related to the logical deductions from the state of the photoswitches in the main beam of the lamp.

The details of display 155 are fully described in the specification of U.S. Ser. No. 806,588 and will not be described now.

FIGS. 2 shows a system of two transverse arrays 56, 58 of photodevices to be partially darkened by a passing golf club shadow so that the relationship as between the number of photodevices darkened in the upstream array to those darkened in the downstream array is an indication of golf club direction in the club-ball impact area.

Thus thirteen photoswtiches 8 to 20 inclusive form array 56 and thirteen photoswitches 21 and 33 inclusive form Array 57. The logical data from the passing club tip shadow falling on these two arrays is used to determine the degree of hooking, slicing or correct straightness of impact direction of a club stroke.

The term 'photo switch' is used to describe two-state photoelectric devices available on the commercial market. But it can be used generally to refer to photocells of appropriate speed and with a following amplifier or device which effectively permits it to be used in a two-state system.

The present application is concerned with the optimum location of the two arrays 56 and 57 for maximum accuracy.

If the downstream array, that is array 57, is located close to the point of where the club tip shadow corresponds to the impact between club and ball then the swinging radius of the shadow 5 cuts the upstream array 56 in a different proportion even though at impact the club is travelling in the correct strike direction of straightness. This error is calculable:

Typical distance of radius of club head round the golfers shoulder = 62 inches

Typical angle of club swing to the vertical = 34 degrees

Therefore arc of club in the ground plane = 62/Sin 34 = 113 inches.

Assuming that the club tip shadow is travelling in the correct straight strike direction through the downstream array then:

$$\text{Error } E = \frac{D^2}{2R_2} = \frac{6}{2 \times 113} = \cdot 16 \text{ inches}$$

where

R is the ground plane radius of 113 inches derived earlier D is the distance between the two arrays typically at 6 inches.

E is error in inches

If the photodevices in each array are spaced apart by 0.2 inches then crossing a correcting line between corresponding photodevices in each array creates a mean directional angle of 2 degrees and thus the error averages $0.16/2 \times 2 = 1.6$ degrees as 5 of FIG. 2.

Such an error is thus appreciable and to correct it the arrays should be arranged as shown in FIG. 2 and related to a ball position at 300 so that the two arrays 56, 57 are symmetrically related upstream and downstream about the corresponding club head tip shadow when the club contacts the ball. In this fashion the errors of arc curvature of the club path cancel each other out by symmetry as shown by the path 6.

The output of these two arrays are processed in a manner identical to that described in the specification of the parent application.

However the accuracy of discrimination using digital sensors in two arrays as referred to above is limited by the number of photodevices in each array and with such sensors arranged to define 2 degree increments of off-straight direction the mean deviation is of the order of plus-minus one degree. Ideally there would be an infinite number of sensors in each array and this can be simulated by using two analogue photosensors replacing the two digital arrays. Thus each array may be replaced by a sensor as shown in FIG. 3.

Each sensor consists of a hollow box 301 at one end of which is a slit 302 of approximately 1/10th inch wide and of 2 inches length and which permits light to enter the box. In the box there is a photodevice 303 which is sensitive to the admitted light. The box has its internal surfaces of matt white colour which reflects the light admitted in all directions so that there is established a very uniform internal light flux of the sort which prevails in the scientific principle of the hollow white sphere. If one takes a shadow across the admitting slit it is found that the response from the photodevice is substantially linear to the order of about one percent according to the degree to which the slit is shadowed.

The output from the photodevice 303 is arranged in series with a dropping resistor 304 so that the voltage at the point 305 is proportional to the degree of shadowing and this is taken via a diode 306 to a capacitor 307. The effect of this system is thus to capture the peak voltage corresponding to the peak passing shadow and it is held in the capacitor because of the diode 306. In turn this voltage is taken to a high impedance amplifier 308 where it is converted to a low impedance signal for further manipulation in TTL logic at 309 which is an analogue to digital converter. Thus the output from logic circuit 309 is a number corresponding to the peak shadow falling upon the slit.

The output of two such systems one upstream and one downstream can then be data-processed in a manner identical to that described in U.S. application No. 806,588 where the decoders 61 and 64 provided outputs which were digital numbers corresponding to the number of shadowed photocells. Thus in the present embodiment the two logic circuits 309 will provide binary numbers corresponding to the lengths of the slits 302 shadowed. The subsequent processing of these digital numbers is exactly the same as described in the specification of U.S. Ser. No. 806,588.

In the specification of U.S. Ser. No. 806,588 there is described a separate photodevice for resetting the system on the golf club backswing shadow. An alternative method of resetting the system without using a separate photodevice will now be described.

The two incoming photodevices 1 and 2 which establish the opening and closing of gate controlling clock pulses into a counter for data processing to represent club speed are latched at 38 in the dark state. The output of latched photocell 1 is inverted at 168 and this together with the latched output of photocell 2 are taken to a 2-AND gate 169. Thus this gate 169 will only have a signal output when:

(a) the upstream speed photodevice 1 is in the illuminated condition, and (b) the downstream speed photodevice 2 is in the darkened condition.

This condition is established if the golfer either places his clubhead in a static state over photocell 2 or if he waggles his club from left to right but stops before darkening photocell 1 i.e. it covers all states relevant to left of the centre line between the two speed photodevices.

Figure 4:
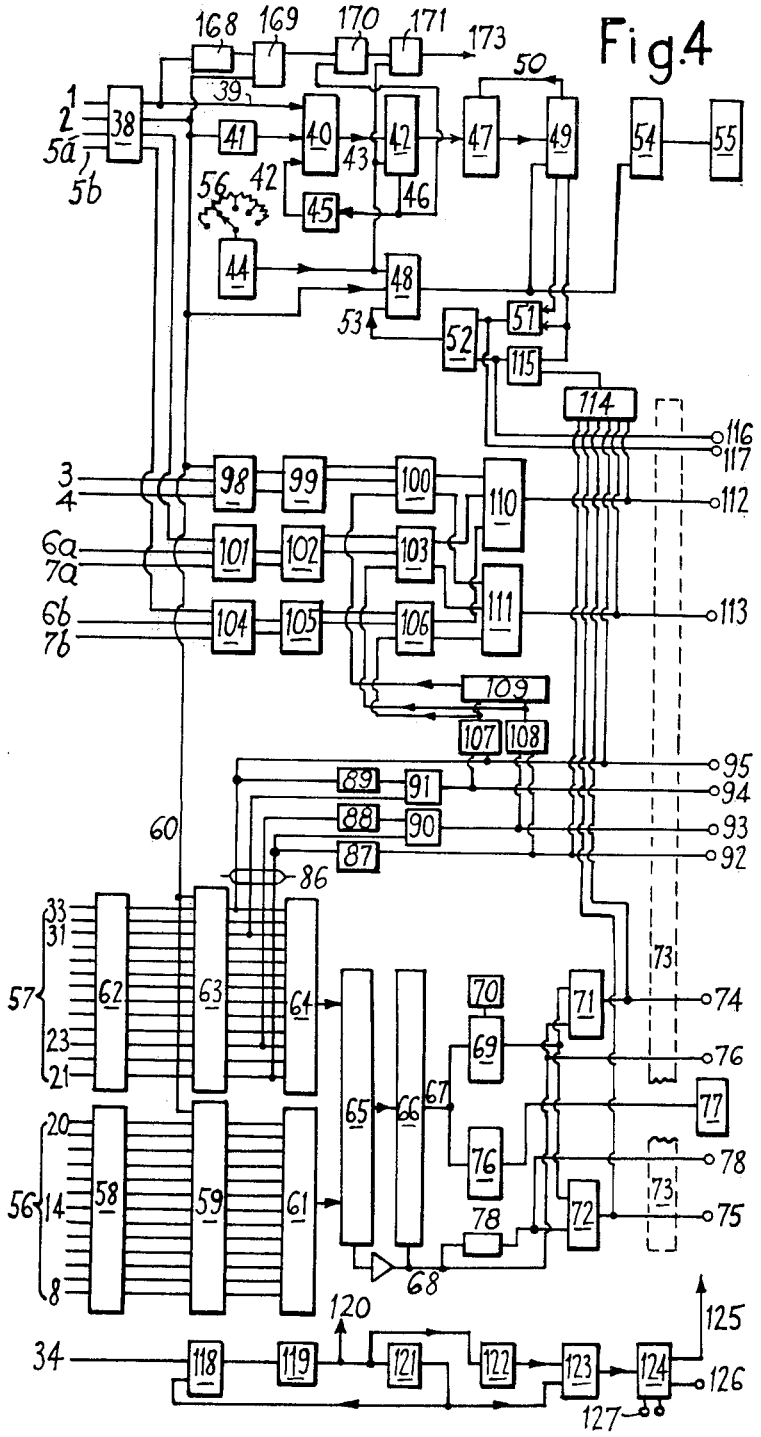
FIG. 4 is a circuit diagram of a data-processing circuit.

The output from the two-AND 169 is taken to a 2-OR gate 170 whose other input is fed from a 'full-counter' signal available at 46 of FIG. 4.

The full counter signal is generated by either:

(a) a slow waggle of the club from left to right starting from the mid-point between photocell 1 and photocell 2, or (b) a slow waggle of the club from left to right but commencing downstream of photocell 2 and passing over photocell 2 and photocell 1, or (c) a slow waggle of the club passing from right to left and passing over photocell 1 and either stopping before photocell 2 or passing over photocell 2.

Thus overall there is an output from the 2-OR gate 170 on any motion of the club head either as to static placing or waggling left or right but which does not create a counter which is only partially full. The output from gate 170 is taken to a 2-AND gate 171 which is also fed from the available clock line at 44. The output from gate 171 thus provides a train of reset pulses under any of the indications described other than a partially filled counter. These pulses replace the original reset system using a separate photodevice and replace line 34 which is described in the parent specification.

Note that the full-counter signal is established when the speed of the club over photocells 1 and 2 in the right to left (striking) direction is so slow (in practice less than 20 ft. per second) that so many clock pulses escape into the counter that it is filled before the clock gate is closed by the darking of photocell 2. It has been found that waggling the club occurs at below this speed so that waggling will establish a full counter and thus reset signals. Only if the club is swung faster than 20 feet per second will the counter only be partially filled corresponding to a true strike. This sytem has the advantage that it is continuously resetting the system from all preliminary club placings or waggles whereas with the use of a separate reset photodevice such a system can be put into a spurious state by a waggle of unduly large magnitude sufficient to trigger such separate reset photodevice.

The ultimate reset signal required for the strike swing is established by the backswing going over photocell 1 which thus establishes the full counter state and on the ensuing strike swing the system establishes a partial filled counter state which inhibits any further resetting action.

In the parent specification there is described how it is desirable to define a characteristic fault of a golfer on a statistical basis over a number of successive swings.

This can be made automatic by replacing the fault display LEDs by counters which keep adding to the display of a fault of a particular nature as to Hook, Slice, Toe, Heel, Open, Shut, No Faults. All that is needed to effect this improvement is to replace the items 74, 92, 95, 113, 112, 117 described in the parent specification by counters and digital displays each of which is fed by a 2-AND gate whose other input is a pulse indicating that a proper swing has taken place. Such a pulse can be triggered into a pulsing unit from the fall to zero of the three-second timing unit 122.

Furthermore the just described feature validating a proper swing can be used to actuate a counter counting the number of swings taken in a successive series and can be numerically displayed by a counter-display unit.

But there can also be available from the above features the number of No Faults in a succession of swings.

Strike Efficiency can be defined as equal to 100×Number of No Faults divided by the number of Swings.

Since the data for the two variables are now available, then the Strike Efficiency can be arithmetically computed by means obvious in the electronic art and the resulting Strike Efficiency can be numerically displayed. After a given series of swings the system can be zeroed by a push-button.

The 'handicap' of a golfer is the number of strokes he takes in a round above the par value for the course which is typically 72 strokes. Since there has been described means for counting the number of No Faults in series of successive golfer's swings and the number of swings then it is obvious in the electronic art also to compute the number of faulty swings by subtraction.

Let the number of swings=S

Let the number of faulty swings=F

Let P be the par of a golf course over 18 holes

Let K be the fraction of a stroke dropped per faulty strike:

Therefore total strokes in a round=$P(1+KF/S)$

The right hand aspect of the above equation as to PKF/S is the golf handicap. Since P is typically 72 strokes and since K is typically 0.5 in that a faulty stroke causes the golfer to lose half a short then $$\text{Handicap}=72\times 0.5\times F/S=36F/S$$

Since the values for F and S are available on counters in the system then the value of 36F/S can be computed in an arithmetic unit and the result displayed numerically.

The golf handicap may be considered as made up of two distinct aspects as to (a) corresponding to dropped strokes because of faulty strokes (b) corresponding to dropped strokes because of lower yardages than are needed to make the green in par figures but which are not faults in themselves but may depend upon the age of a golfer. An examination of the par values on golf courses and the hole yardages involved shows that the following strokes will be dropped on average according to the length of the drive and reflecting proportionately as to the yardage from other clubs:

| | Dropped Strokes | |
|---|---|---|
| Drive Yardage | Men | Women |
| 240 and over | 0 | |
| 230 | 1 | |
| 220 | 2 | |
| 210 | 3 | 0 |
| 200 | 5 | 1 |
| 190 | 6 | 2 |
| 180 | 8 | 3 |
| 170 | 11 | 5 |
| 160 | 14 | 9 |

By using the system for measuring drive yardage a golfer can determine his typical yardage and can then dial this into the system on a multipoint switch which has the effect of adding the corresponding handicap numbers as in the above table to those obtained from faulty strikes as determined earlier. Alternatively in determining the drive yardage the successive values in the drive yardage counters can be added together and divided by the number of swings to give automatically the average drive yardage which can be data-processed to give the handicap figures which correspond thereto and thus added into the handicap based on faulty strikes.

A golf training system such as that described herein requires a ball both for the eye of the golfer to focus his attention upon but also to give the corresponding feel at impact as that of a real golf ball used on the golf course. It has been found that light plastic practice balls are defective for use in practising in that they offer no appreciable resistance to the club at impact and thus the speed of the follow through part of the golf swing is much higher than when using a real golf ball. This effect is highly disturbing to a practising golfer since he feels he is being swung off his feet in the follow through. In a normal full golf swing the club head is slowed down by about 30 percent at ball impact and its kinetic energy is reduced by about 50 percent.

The mechanical impedance of a golf ball is due to three factors as to its mass, its stiffness and its dissipative resistance. A practice golf ball equivalent in feel impact to a real golf ball can be devised by making its mass the same as a real golf ball but by giving it low stiffness compared with the high stiffness of a real golf ball and giving it a high resistive dissipation compared with the low resistive dissipation of a real golf ball.

Appropriate materials for such a ball are available from the plastics industry and outstandingly isobutylene-isoprene polymer. This can be weighted with fillers such as sand to have the same weight as a real golf ball and can be moulded either with or without a golf ball cover of standard nature.

In finalising the design of such a practice golf ball as to its exact composition the test is that it must reduce the speed of a golf club at ball impact to the same degree as that of a real golf ball such as by 30 percent when using an 8 ounce headed driving club.

Such a golf ball has the advantage that it does not need a practice net when used indoors and it can be used against a wall and will not appreciably bounce back due to its coefficient of restitution being less than 10 percent.

I claim:

1. In golf training apparatus comprising:

(a) a base member having an impact area over which a golfer may swing a golf club to strike a target ball carried in the impact area;

(b) a light source arranged to direct light onto the impact area to cause a shadow of the golf club head to fall onto the impact area as the club swings across the area;

(c) a plurality of photodevices distributed in said area so as to receive light from said light source and which may be shadowed momentarily during the passage of the club across the impact area;

(d) signal processing means for correlating signals received from said photodevices during the passage of the golf club over the impact area to provide data relating to an impact of the club on the target ball, the improvement consisting in that said photodevices include (e) first and second transverse photodevices for the detection of club head direction, said first and second photodevices each comprising:

(i) a body enclosing a chamber and having an aperture therein defining a slit, the internal surfaces of the chamber being such that light admitted into the chamber via the slit is reflected in such a manner that a uniform internal light flux is established in the chamber;

(ii) a photodetector mounted in said chamber whereby the output of the photodevice in response to the internal light flux of the chamber is linearly proportional to the extent to which the slit is shadowed;

(iii) a peak detection circuit to which the output of said photodevices connected, and (iv) an analog-digital converter to which the output of said peak detection circuit is connected and operative to provide a binary number representative of the length of the slit masked, and wherein the slits of said first and second photodevices are located symmetrically on either side of a line tangential to the target ball and at right angles to an ideal path of a golf club head when it impacts the target ball.

2. The apparatus as defined in claim 1 and further including (a) first and second photocells located in the path of the club as it swings to pass over the impact area;

(b) pulse generator means for generating a train of pulses;

(c) gate means to the inputs of which the outputs of said first and second photocells are respectively connected, and operative to gate the train of pulses from said pulse generator means, (d) a counter having an input to which the output of said gate means is connected, and (e) means responsive to said counter and operative to generate a train of reset pulses.

* * * * *